US010214345B1

(12) United States Patent
Howie

(10) Patent No.: US 10,214,345 B1
(45) Date of Patent: Feb. 26, 2019

(54) ENTRYWAY PROTECTIVE COLLAR

(71) Applicant: Cameron Gordon Howie, St. Johns, MI (US)

(72) Inventor: Cameron Gordon Howie, St. Johns, MI (US)

( * ) Notice: Subject to any disclaimer, the term of this patent is extended or adjusted under 35 U.S.C. 154(b) by 502 days.

(21) Appl. No.: 13/684,317

(22) Filed: Nov. 23, 2012

Related U.S. Application Data

(60) Provisional application No. 61/630,395, filed on Dec. 12, 2011.

(51) Int. Cl.
*B65D 90/10* (2006.01)
*B65D 90/20* (2006.01)

(52) U.S. Cl.
CPC ..... *B65D 90/105* (2013.01); *B65D 90/20* (2013.01)

(58) Field of Classification Search
CPC ..... B65D 90/105; B65D 90/20
USPC ..... 138/96 R, 109, 110; 174/665, 152 R; 242/615, 615.4; 404/25, 26; 52/20; 254/134.3 R
See application file for complete search history.

(56) References Cited

U.S. PATENT DOCUMENTS 1,498,563 A * 6/1924 Morrison et al. ..... 138/96 R
1,673,145 A * 6/1928 Gschwind ..... 404/26
1,908,909 A * 5/1933 Manz ..... 52/19
2,195,403 A * 4/1940 Bay ..... 285/213
2,209,274 A * 7/1940 Jaberg ..... 174/83
2,409,396 A * 10/1946 Seiler ..... 137/375
2,997,932 A * 8/1961 Taylor ..... 404/26
3,005,620 A * 10/1961 Trunnell ..... 254/134.3 R
3,120,290 A * 2/1964 Kamrath ..... 182/169
3,294,000 A * 12/1966 Pelsue ..... 404/26
3,322,093 A * 5/1967 Goland et al. ..... 116/63 R
3,360,173 A * 12/1967 Miller ..... 242/615
3,401,869 A * 9/1968 Doyle ..... 417/423.15
3,525,290 A * 8/1970 Pelsue ..... 135/126
3,589,403 A * 6/1971 Chase ..... 138/137
3,610,524 A * 10/1971 Wallen ..... 454/48
3,615,984 A * 10/1971 Chase ..... 156/94
3,703,219 A * 11/1972 Jones ..... 182/46
3,883,271 A * 5/1975 Mertes ..... 417/234
3,921,673 A * 11/1975 Pero ..... 138/109
3,974,599 A * 8/1976 Grosh ..... 52/20
(Continued)

OTHER PUBLICATIONS

Web Site http://lightringinc.com.
Web Site https://www.facebook.com/LightRinginc.

*Primary Examiner* — Patrick M Buechner
*Assistant Examiner* — Michael J Melaragno
(74) *Attorney, Agent, or Firm* — Papalas PLLC

(57) ABSTRACT

Embodiments of the invention are directed to a protective collar that covers the edges of a manhole or other personnel entryway. One device comprises at least two pieces and a hinge that connects the two pieces, which allows the device to be folded for storage. Another device includes a skirt portion that extends further into the manhole. A further device includes at least one light to provide light into the manhole. A still further device includes a surface port that provides a connecting point for a line, and a subsurface port that provides a connecting point for another line. A still further device includes another portion to cover any equipment that has been inserted into the manhole. A still further device includes at least one rung to assist in personnel in entering and exiting the manhole.

31 Claims, 12 Drawing Sheets

(56) References Cited

U.S. PATENT DOCUMENTS 4,013,374 A * 3/1977 Weiler et al. ..... 404/25
4,068,480 A * 1/1978 Lefever et al. ..... 405/59
4,157,100 A * 6/1979 Turk ..... 138/96 T
4,187,647 A * 2/1980 Hall ..... 52/20
4,285,269 A * 8/1981 Pelsue et al. ..... 454/338
4,305,478 A * 12/1981 Geisinger ..... 182/3
4,337,005 A * 6/1982 LeBaron ..... 404/26
4,363,313 A * 12/1982 Smith ..... 126/9 R
4,412,672 A * 11/1983 Zelins ..... 254/134.3 R
4,621,941 A * 11/1986 Ditcher et al. ..... 404/26
4,650,365 A * 3/1987 Runnels ..... 404/25
4,737,220 A * 4/1988 Ditcher et al. ..... 156/218
4,794,956 A * 1/1989 Gordon et al. ..... 138/39
4,829,975 A * 5/1989 Hait ..... 126/9 R
4,836,432 A * 6/1989 Violette ..... 242/615
4,838,439 A * 6/1989 Baziuk ..... 212/179
4,842,784 A * 6/1989 Takahashi ..... 264/1.9
4,867,601 A * 9/1989 Bowman ..... 404/26
4,872,780 A * 10/1989 Bowman ..... 404/26
4,896,650 A * 1/1990 Hait ..... 126/9 R
4,919,564 A * 4/1990 Neathery et al. ..... 404/25
4,927,290 A * 5/1990 Bowman ..... 404/26
4,936,703 A * 6/1990 Ferns ..... 404/25
4,963,053 A * 10/1990 Bowman ..... 404/26
4,966,489 A * 10/1990 Bowman ..... 404/26
4,969,771 A * 11/1990 Bowman ..... 404/26
4,982,653 A * 1/1991 Gordon et al. ..... 454/335
5,052,851 A * 10/1991 Frishauf ..... 404/25
5,106,440 A * 4/1992 Tangeman ..... 156/94
5,165,819 A * 11/1992 Bowman ..... 404/26
5,205,668 A * 4/1993 Adams ..... 404/26
5,211,504 A * 5/1993 Trudel ..... 404/26
5,308,188 A * 5/1994 Shaftner ..... 404/25
5,316,407 A * 5/1994 Miller ..... 404/25
5,401,114 A * 3/1995 Guggemos ..... 404/25
5,427,339 A * 6/1995 Pauli et al. ..... 248/75
5,496,128 A * 3/1996 Odill ..... 404/25
5,564,855 A * 10/1996 Anderson ..... 404/26
5,595,455 A * 1/1997 Svirklys ..... 404/25
5,622,208 A * 4/1997 Vinson ..... 138/89
5,727,351 A * 3/1998 Neathery et al. ..... 52/20
5,769,565 A * 6/1998 Martin et al. ..... 404/25
5,800,648 A * 9/1998 House et al. ..... 156/71
5,813,797 A * 9/1998 Pendleton et al. ..... 405/52
5,827,007 A * 10/1998 Barton et al. ..... 404/25
5,842,811 A * 12/1998 Johnson ..... 404/25
5,899,024 A * 5/1999 Stannard ..... 52/20
5,944,442 A * 8/1999 Roush et al. ..... 404/26
5,951,200 A * 9/1999 Barton ..... 404/25
5,957,618 A * 9/1999 Sims et al. ..... 404/25
5,996,525 A * 12/1999 Gray ..... 114/253
6,018,914 A * 2/2000 Kamiyama et al. ..... 52/20
6,024,242 A * 2/2000 Stevenson ..... 220/567.1
6,055,682 A * 5/2000 Sanchez ..... 4/496
6,161,984 A * 12/2000 Sinclair ..... 404/25
6,210,270 B1 * 4/2001 Niksic et al. ..... 454/338
6,237,768 B1 * 5/2001 Cipriani ..... 206/408
6,385,913 B1 * 5/2002 Ahn ..... 52/20
6,425,387 B1 * 7/2002 Rohback, Jr. ..... 126/9 R
6,435,763 B1 * 8/2002 Sakane et al. ..... 404/25
6,464,425 B1 * 10/2002 Closkey ..... 404/26
6,488,444 B2 * 12/2002 Licata ..... 405/52
6,520,713 B2 * 2/2003 Sondrup ..... 404/26
6,524,026 B2 * 2/2003 Sondrup ..... 404/26
6,719,243 B1 * 4/2004 Haverty ..... 242/615.4
6,889,948 B2 * 5/2005 Melancon et al. ..... 248/309.1
7,165,911 B2 * 1/2007 Fier ..... 404/26
D560,469 S * 1/2008 Bartol et al. ..... D8/349
7,336,181 B2 * 2/2008 Nowak et al. ..... 340/572.1
7,339,477 B2 * 3/2008 Puzio et al. ..... 340/572.1
7,347,455 B1 * 3/2008 Taquino ..... 285/124.1
7,429,022 B2 * 9/2008 Vetesnik ..... 248/218.4
7,503,083 B2 * 3/2009 Ball ..... 4/650
7,504,949 B1 * 3/2009 Rouaix et al. ..... 340/572.1
7,556,055 B2 * 7/2009 DeCourcy et al. ..... 137/240
7,690,593 B2 * 4/2010 Bender et al. ..... 242/171
7,755,482 B2 * 7/2010 Hubbard ..... 340/568.1
7,777,628 B2 * 8/2010 Tilson, Jr. ..... 340/572.1
7,866,915 B2 * 1/2011 Pendleton et al. ..... 404/25
7,883,290 B1 * 2/2011 Ross et al. ..... 404/25
7,938,352 B2 * 5/2011 Fabian ..... 242/172
8,024,916 B2 * 9/2011 Kuebel ..... 59/78.1
8,042,757 B2 * 10/2011 Bender et al. ..... 242/171
8,077,101 B1 * 12/2011 Mastarone et al. ..... 343/719
8,087,372 B1 * 1/2012 Ruffa ..... 114/254
8,342,483 B1 * 1/2013 Manning ..... 254/134.3 R
8,368,518 B1 * 2/2013 Castrovinci ..... 340/10.51
8,522,487 B2 * 9/2013 Whiting et al. ..... 52/19
8,540,454 B2 * 9/2013 Lee ..... 404/26
8,607,376 B2 * 12/2013 Ball ..... 4/650
8,684,061 B2 * 4/2014 Porter, IV ..... 160/10
8,794,561 B2 * 8/2014 Fabian ..... 242/423.1
8,807,873 B2 * 8/2014 Kiest, Jr. ..... 405/184.2
8,814,993 B2 * 8/2014 Yano ..... 96/4
2001/0033769 A1 * 10/2001 Newman ..... 404/26
2003/0102970 A1 * 6/2003 Creel et al. ..... 340/568.1
2004/0217864 A1 * 11/2004 Nowak et al. ..... 340/572.1
2004/0261871 A1 * 12/2004 Angelico ..... 138/39
2005/0115173 A1 * 6/2005 Joyce et al. ..... 52/200
2005/0229982 A1 * 10/2005 Gonzales ..... 137/590
2007/0031190 A1 * 2/2007 Meyers ..... 404/26
2007/0223226 A1 * 9/2007 Park ..... 362/267
2007/0291473 A1 * 12/2007 Traynor ..... 362/106
2008/0028688 A1 * 2/2008 Neuber ..... 52/20
2008/0142108 A1 * 6/2008 Baker et al. ..... 138/96 R
2009/0014572 A1 * 1/2009 Weissbrod et al. ..... 242/128
2009/0014579 A1 * 1/2009 Bender et al. ..... 242/615.4
2009/0261196 A9 * 10/2009 Bender et al. ..... 242/615.4
2010/0019912 A1 * 1/2010 Wander ..... 340/632
2010/0031573 A1 * 2/2010 Whiting et al. ..... 49/31
2010/0155523 A1 * 6/2010 Bender et al. ..... 242/615.4
2011/0268501 A1 * 11/2011 Lee ..... 404/25
2012/0141210 A1 * 6/2012 Kiest, Jr. ..... 405/150.2
2013/0340353 A1 * 12/2013 Whiting et al. ..... 52/19
2014/0020716 A1 * 1/2014 Suiter ..... 134/21
2014/0202722 A1 * 7/2014 Cordani ..... 169/54
2014/0366977 A1 * 12/2014 Kanao ..... 138/97
2015/0096770 A1 * 4/2015 Cordani ..... 169/54

* cited by examiner

ENTRYWAY PROTECTIVE COLLAR

RELATED APPLICATIONS

This Application claims priority from Provisional Application No. 61/630,395 entitled "Manhole Protection Ring ("MPR")", filed on 12 Dec. 2011, the disclosure of which is hereby incorporated herein by reference.

TECHNICAL FIELD

Embodiments of the invention are directed, in general, to protective coverings for equipment, and in specific, to a protective collar that is used to cover abrupt edges in an entryway.

BACKGROUND

Manholes are surface access points for underground utilities, and other infrastructure features. Manholes typically comprise a metal ring into which a metal cover is placed. The cover is removed to allow access to the manhole. Most manholes are round because the diameter of the cover is always larger than the diameter of the manhole, and therefore the cover cannot pass into the manhole. However, some manholes have other shapes, such as square or rectangle.

In order to ensure a tight fit between the manhole and the cover, the manhole typically has sharp edges in the ring. The sharp edges, however, over time can damage equipment that is lowered into the manhole, for example hoses and cables, as well as other pieces of equipment, such as tools, sensors, test devices, etc. The sharp edges can cut into/or cause fraying of the hose and cables, as well as damage other equipment, and thus render them unusable, requiring replacement. The sharp edges may also injure personnel as they enter or exit the manhole.

This problem is particularly prevalent for rescue personnel that are conducting emergency services inside a manhole. The rescue personnel need to quickly lower/raise equipment, cables, hoses, personnel, etc. into the manhole to provide services such as fire suppression and medical rescue of civilians.

Currently, ad-hoc measures are taken to attempt to protect equipment, such as using articles of clothing, e.g. firefighter's jackets, or pieces of fire hose, to line a portion of the manhole. However, as items are raised/lowered in the manhole, the ad-hoc measures typically fall into the manhole. Other measures include using a roller system that is placed adjacent to the manhole. To prevent the roller system from falling into the manhole, the roller system is typically spiked into the road. This undesirably damages the road. Also, the roller system only covers a portion of the manhole, leaving the ring exposed on other portions.

SUMMARY

Embodiments of the invention are directed to a protective collar that covers the edges of a manhole or other person entryway.

One embodiment is a device that comprises a first portion that has a diameter that is larger than that of a manhole and covers a surface that is adjacent to the manhole; a second portion that has a diameter that is smaller than that of the manhole and extends into the opening of the manhole; and a third portion that connects the first portion and the second portion to form a continuous surface between the first portion and the second portion.

BRIEF DESCRIPTION OF THE DRAWINGS

Figure 1:
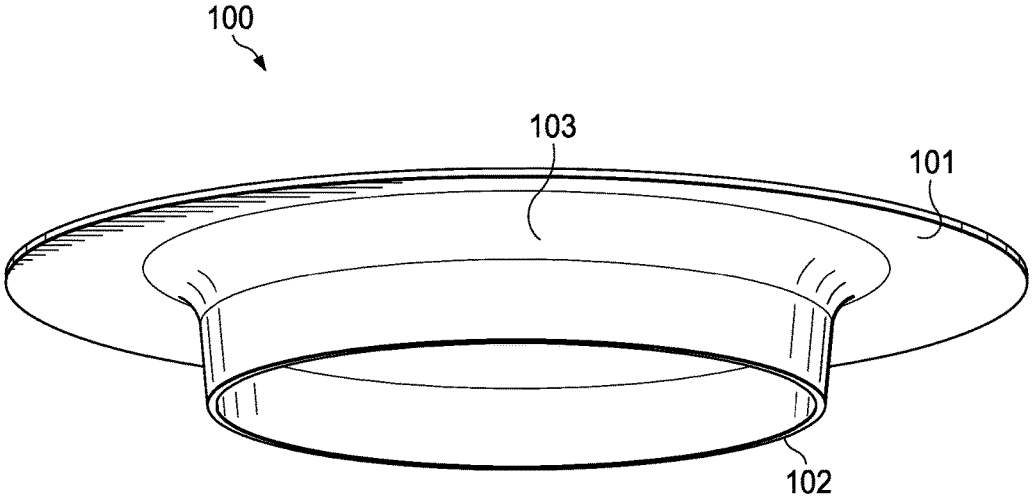
Figure 2:
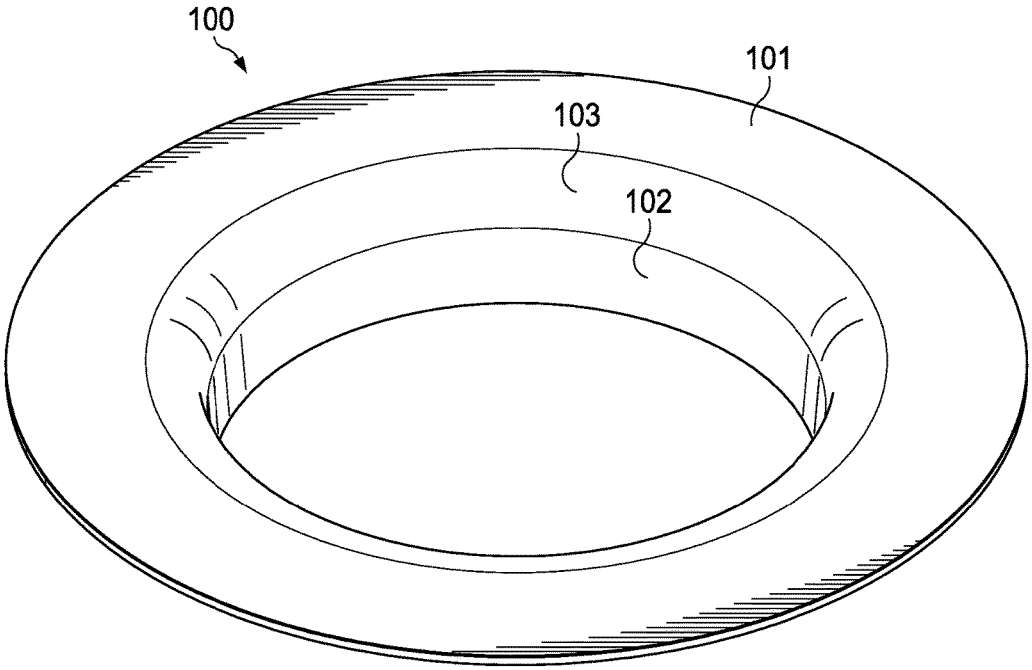
Figure 3:
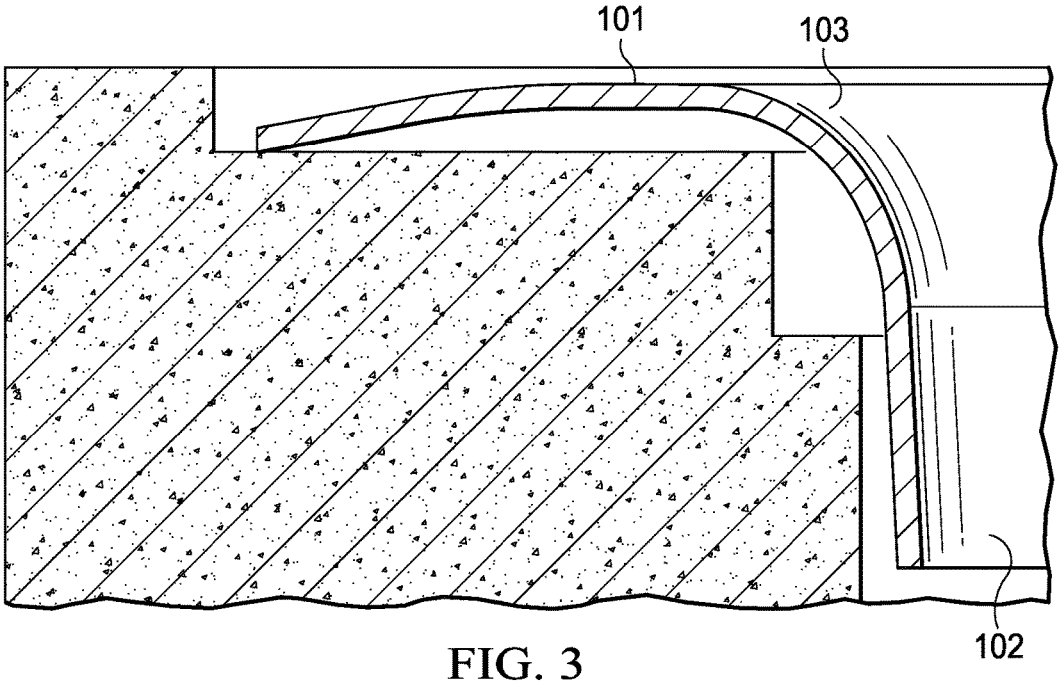
Figure 4:
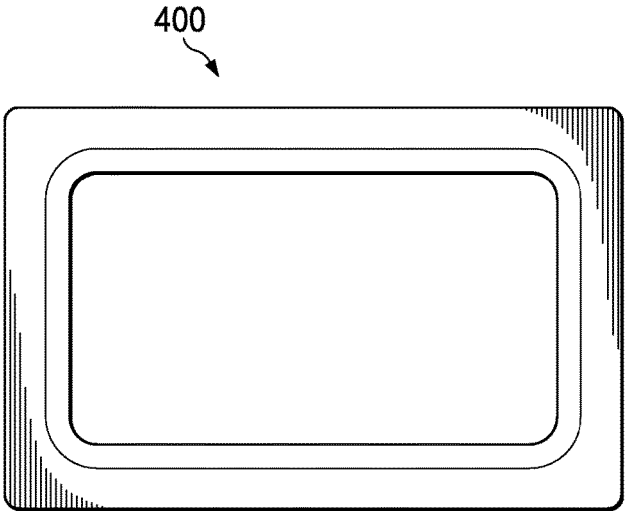
Figure 5A:
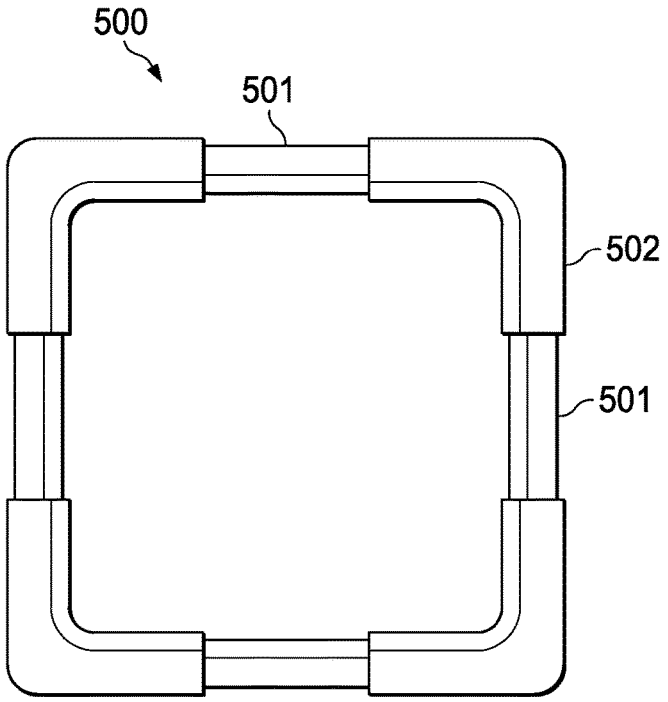
Figure 5B:
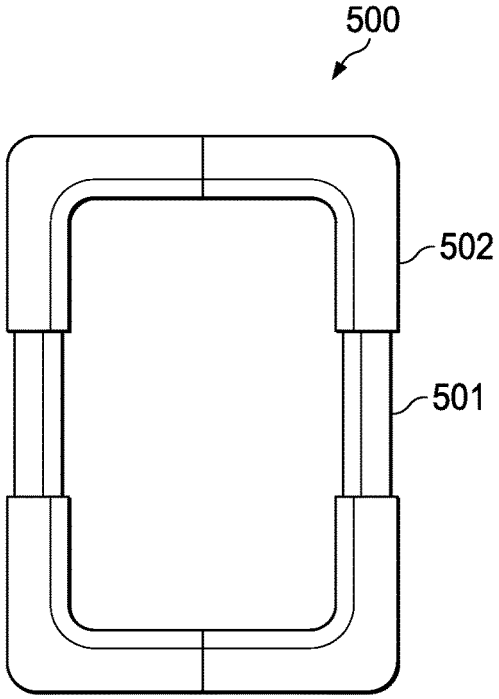
Figure 6:
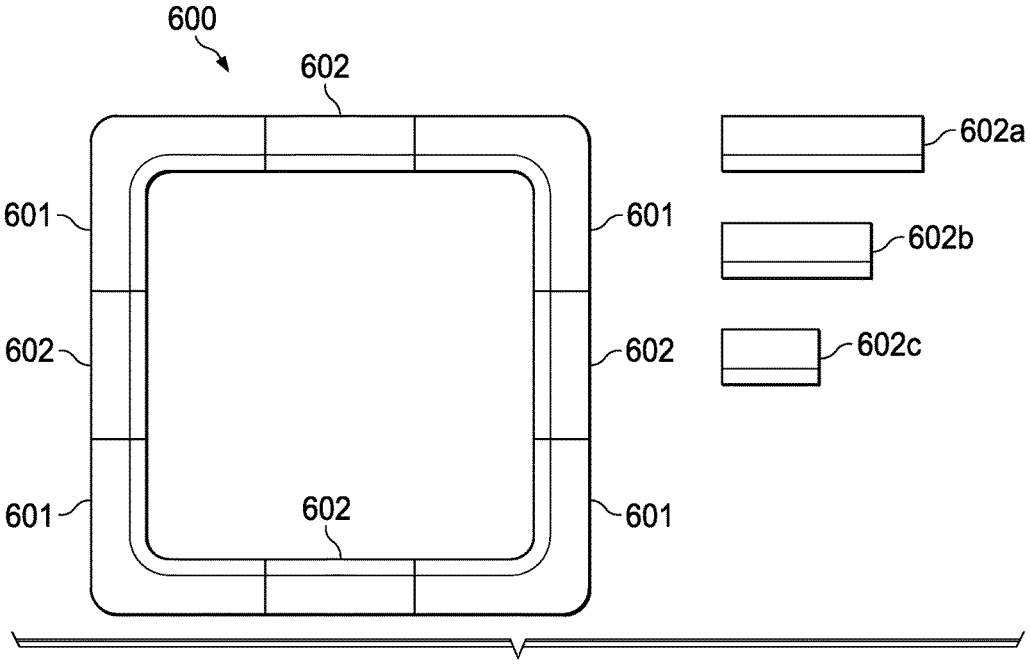
Figure 7:
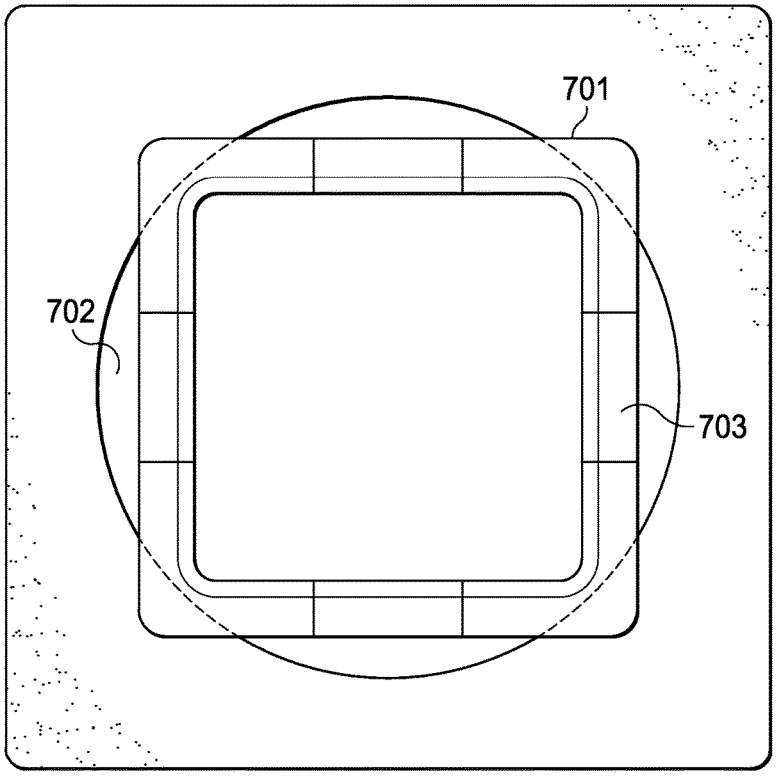
Figure 8A:
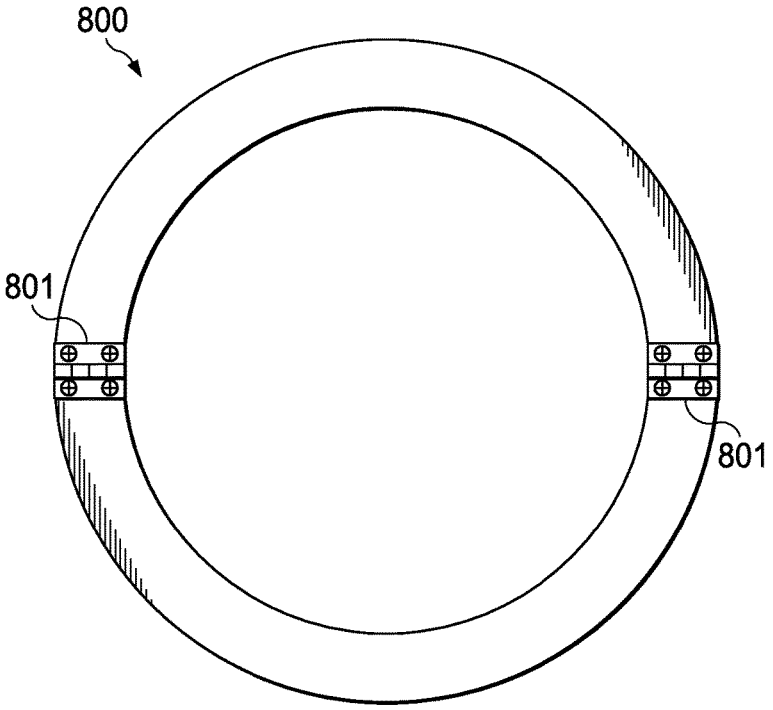
Figure 8B:
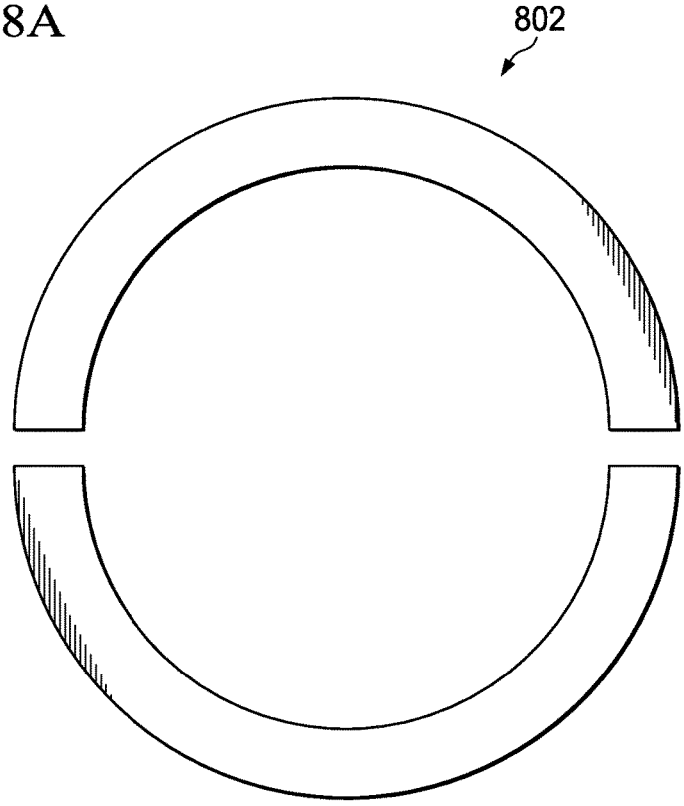
Figure 9:
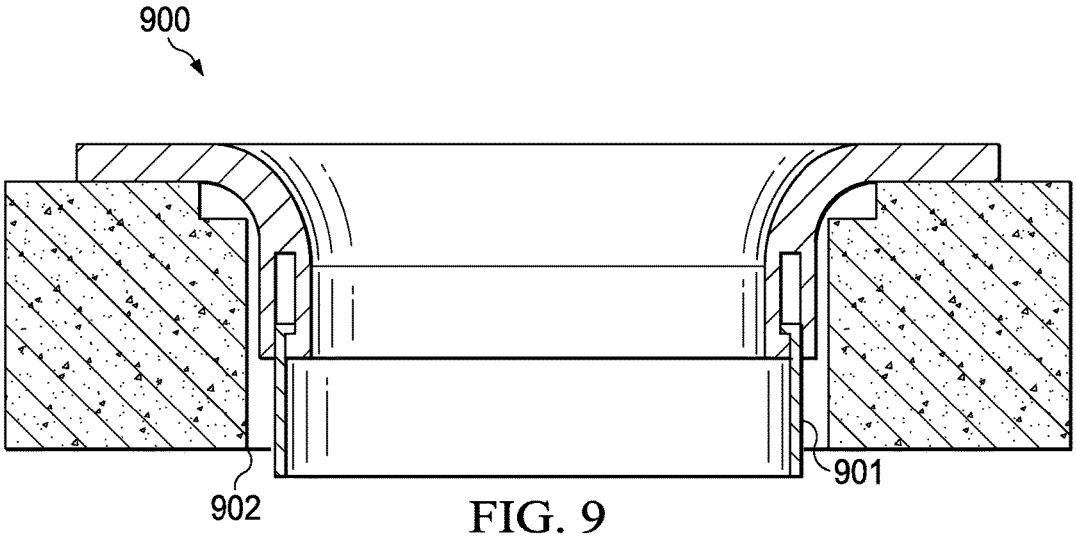
Figure 10:
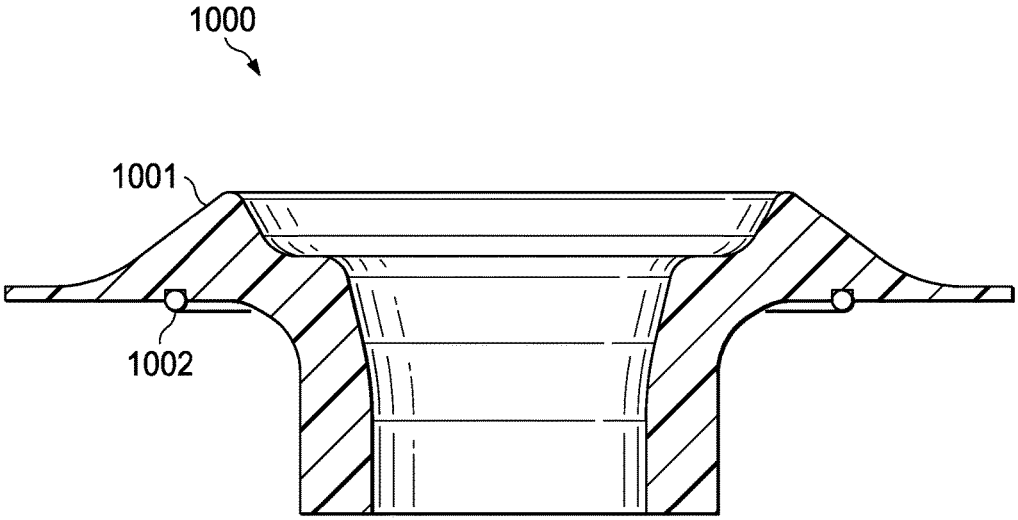
Figure 11:
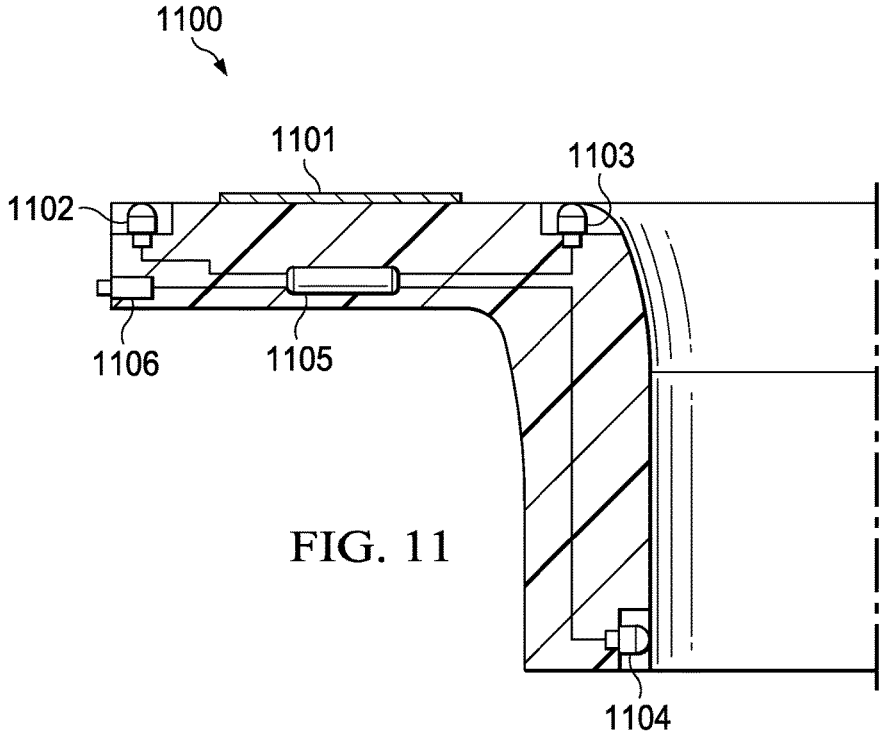
Figure 12:
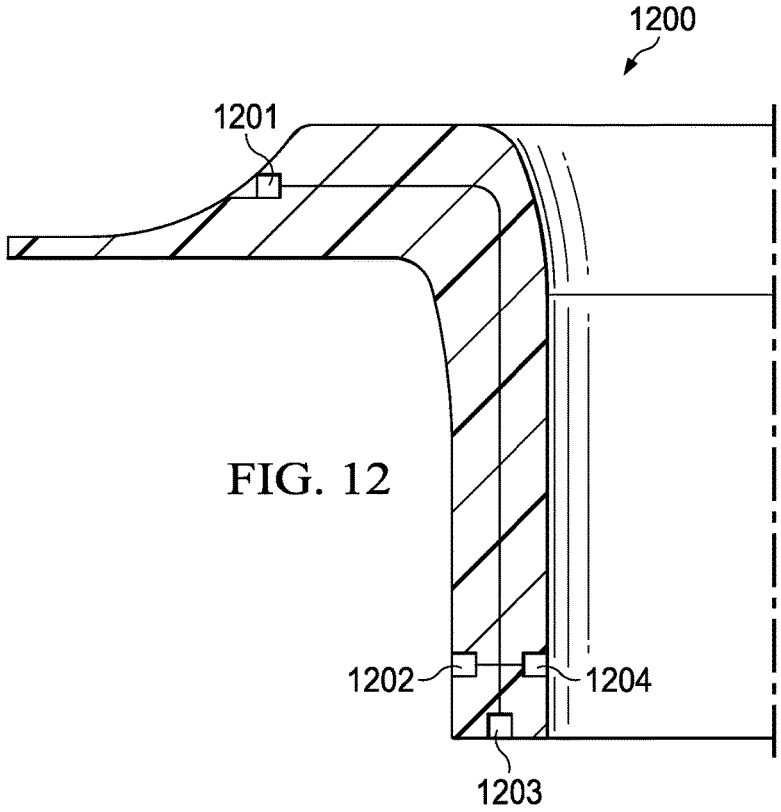
Figure 13:
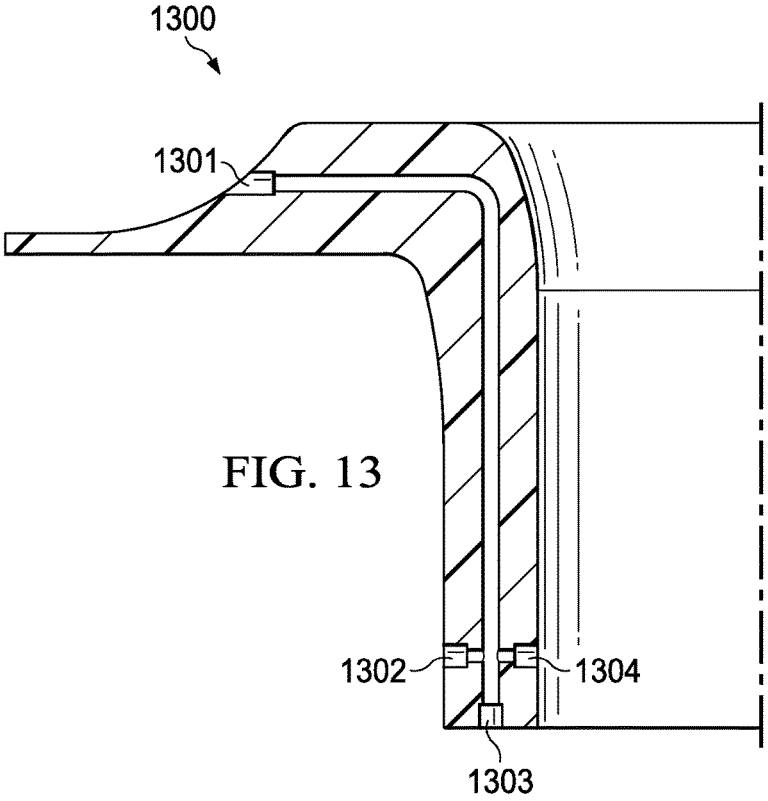
Figure 14:
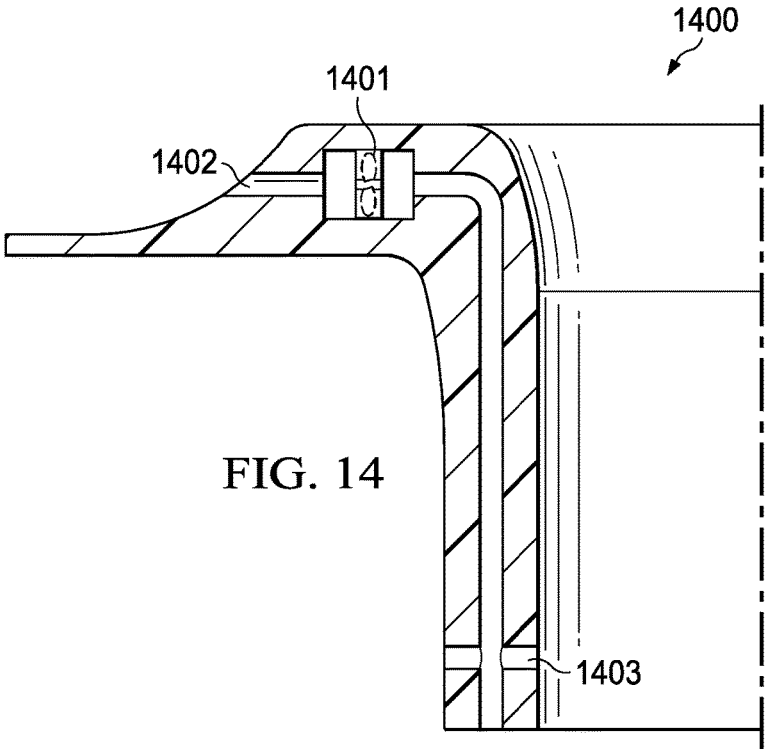
Figure 15A:
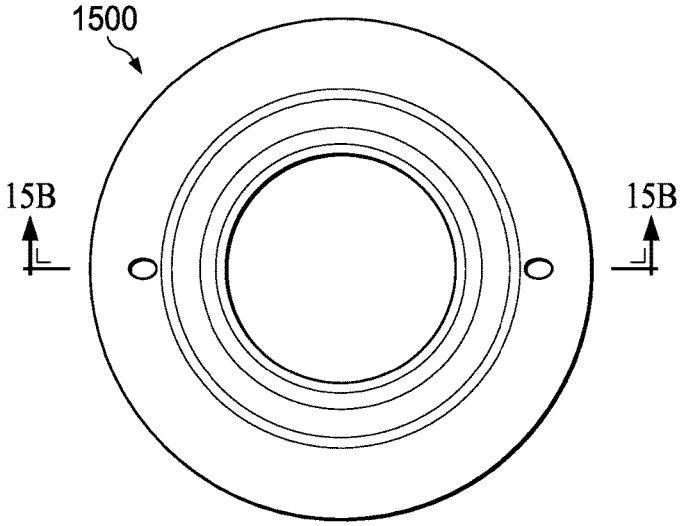
Figure 15B:
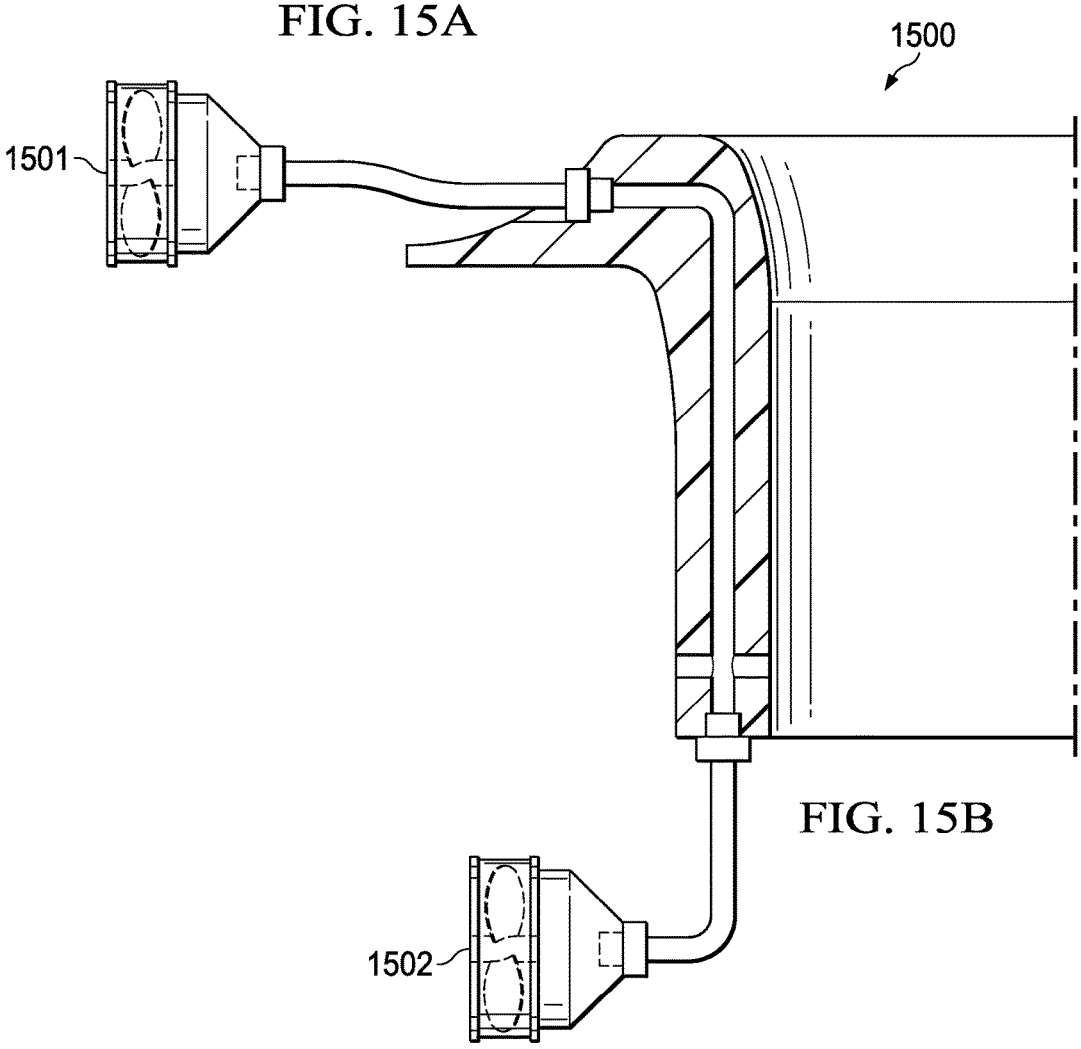
Figure 16:
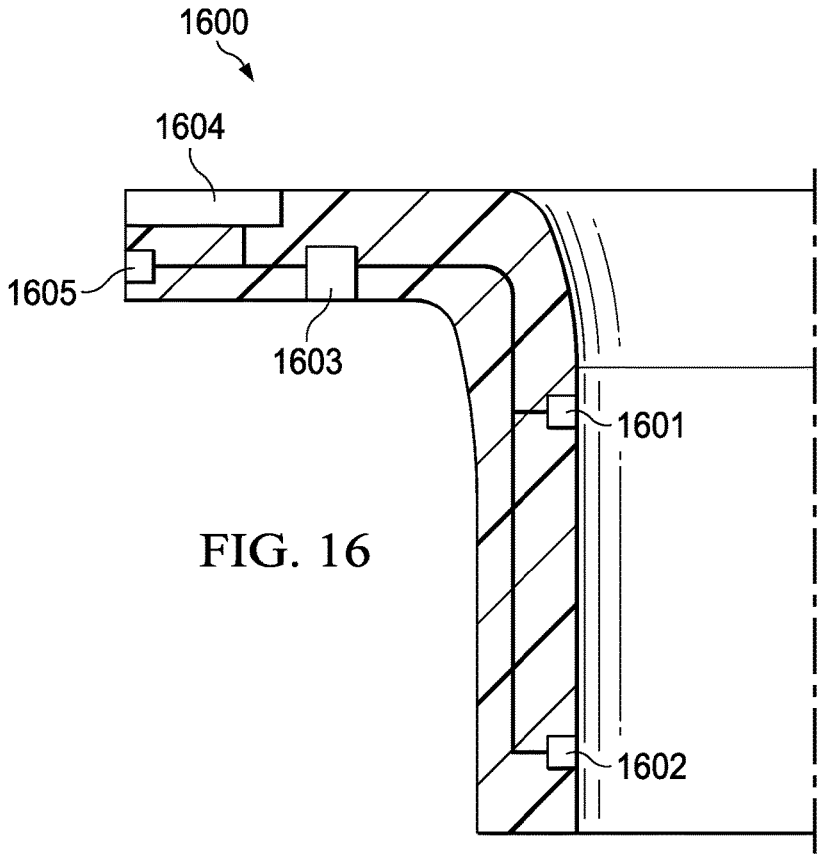
Figure 17:
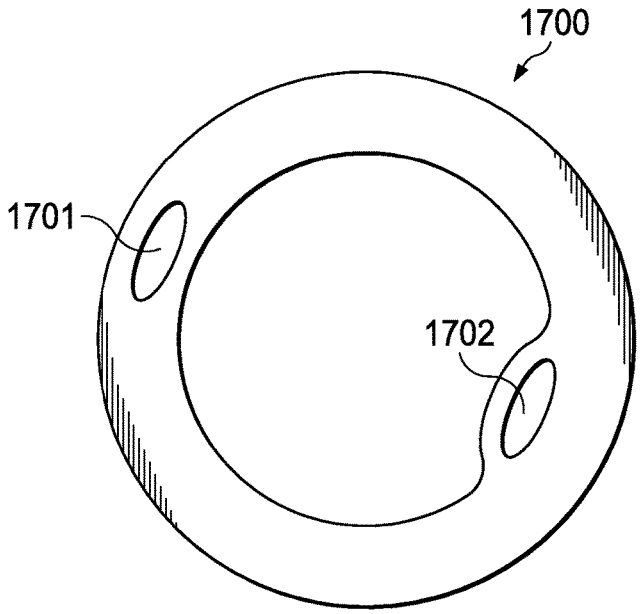
Figure 18A:
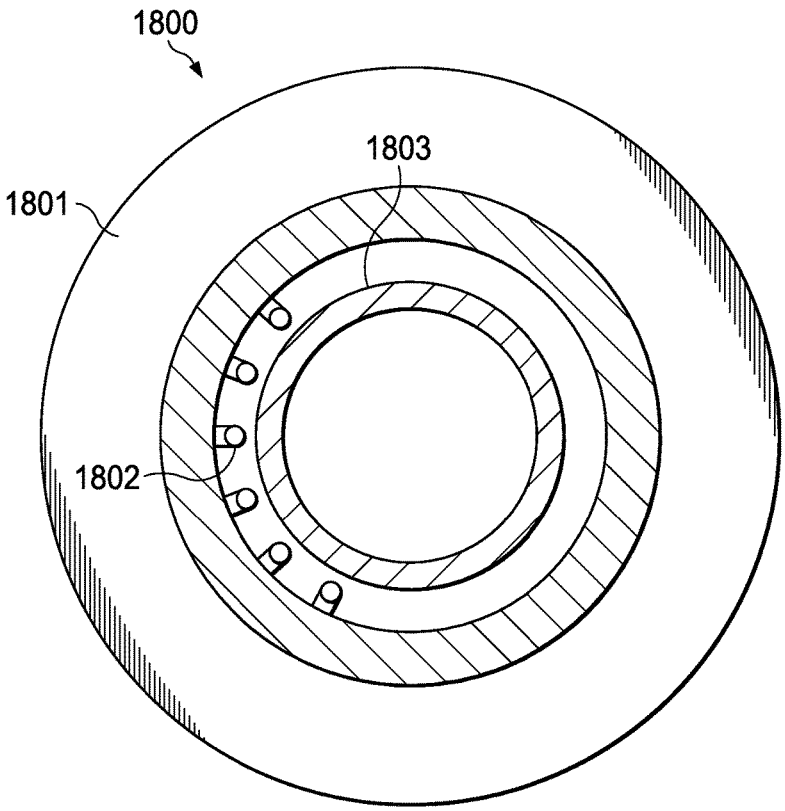
Figure 18B:
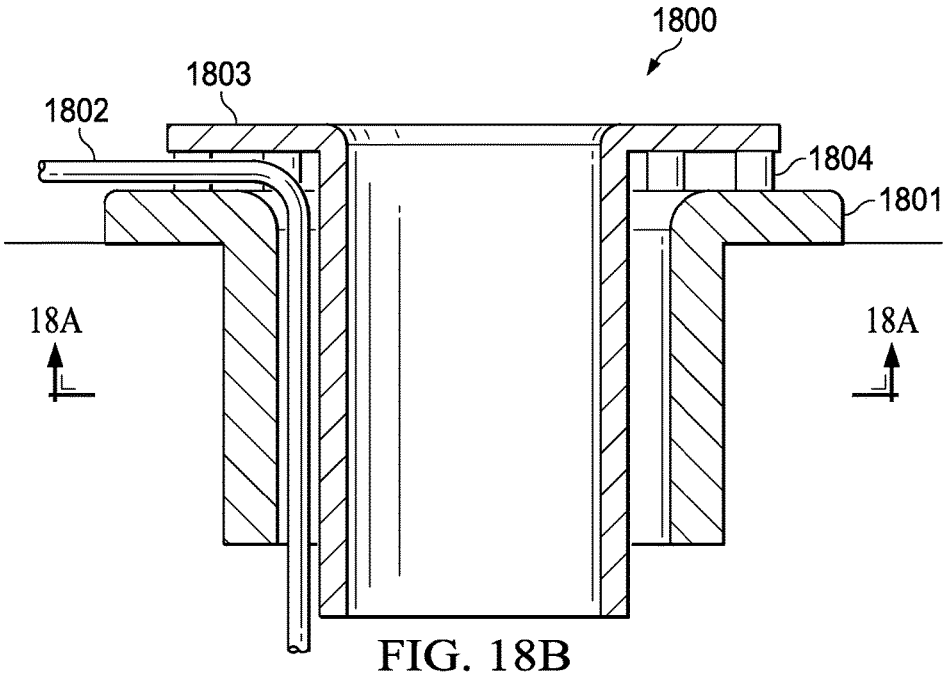
Figure 19:
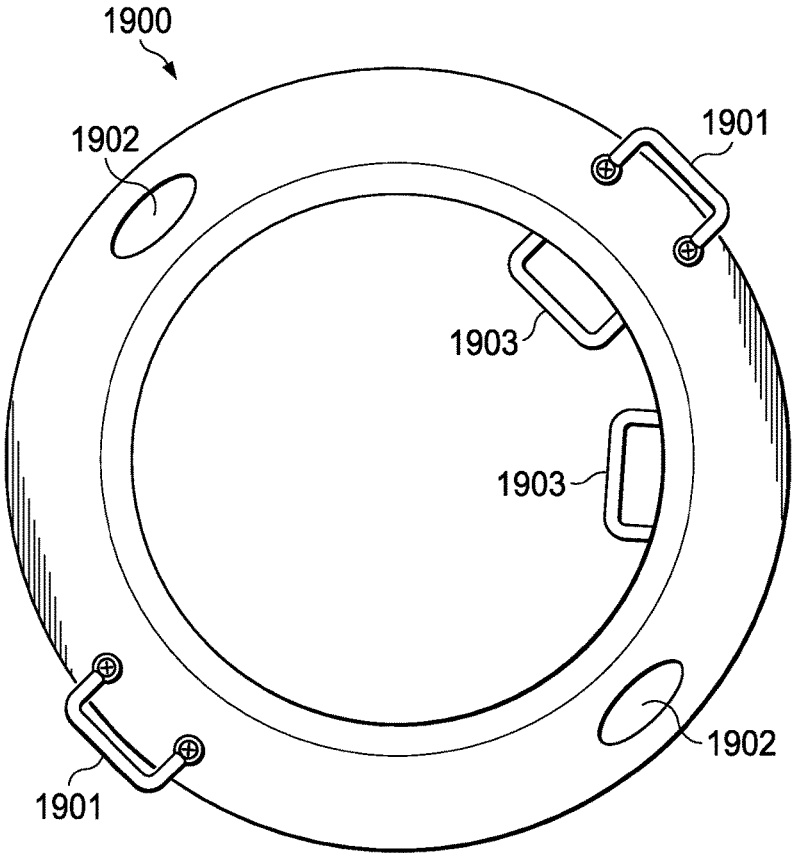

Having thus described the invention in general terms, reference will now be made to the accompanying drawings, which are not necessarily drawn to scale, and wherein:

FIG. 1 depicts a first perspective view of an example collar;

FIG. 2 depicts a second perspective view of the example collar;

FIG. 3 depicts a cross-section view of the example collar when inserted in a manhole;

FIG. 4 depicts an example of a rectangular collar;

FIGS. 5A and 5B depict an example of a collar that includes moveable portions;

FIG. 6 depicts an example of a collar that is comprised of different sized side portions;

FIG. 7 depicts a square collar placed into circular manhole;

FIGS. 8A and 8B depicts example collars that include a hinge and are comprised of multiple pieces to allow for easier storage;

FIG. 9 depicts an example of a collar that includes an extendable skirt portion;

FIG. 10 depicts an example of a collar that includes a raised upper portion and a seal on the lower portion;

FIG. 11 depicts an example of a collar that includes a reflective portion and lights;

FIG. 12 depicts an example of a collar that includes a USB or power ports;

FIG. 13 depicts an example of a collar that includes an oxygen or breathable air ports;

FIG. 14 depicts an example of a collar that includes forced air ducts;

FIGS. 15A and 15B depict an example of a collar that includes air ducts;

FIG. 16 depicts an example of a collar that includes a counter system;

FIG. 17 depicts an example of a collar that includes ports for line passage through the collar;

FIGS. 18A and 18B depict an example of a collar that comprises two pieces, and inner piece and an outer piece; and FIG. 19 depicts an example of a collar that includes hand rungs and handles.

DETAILED DESCRIPTION

The invention now will be described more fully hereinafter with reference to the accompanying drawings. This invention may, however, be embodied in many different forms and should not be construed as limited to the embodiments set forth herein. Rather, these embodiments are provided so that this disclosure will be thorough and complete, and will fully convey the scope of the invention to those skilled in the art. One skilled in the art may be able to use the various embodiments of the invention.

The collar or Manhole Protection Ring ("MPR") is a device used to protect equipment being lowered into manholes, which typically is done via cable/rope that would rub against the manhole edges. Given the presence of sharp edges on both the upper and lower ledges of ring of the manhole, the collar is designed to be placed into the manhole to allow for equipment and personnel to enter and exit the manhole without being subjected to contact with the sharp edges of the manhole.

When the collar is inserted into the manhole, the sharp edges are covered by the rounded surfaces of the collar, thus allowing equipment and/or personnel to enter and exit the manhole more effectively and/or more quickly, with less stress. This allows the equipment to last longer and prevents injury to personnel.

When access to the manhole is finished, the collar is retrieved from the manhole, and the manhole cover is replaced. The collar may then be used again on the manhole or on other manholes as needed.

The collar can be made from numerous materials including different types of plastics (e.g. ABS plastic), metals (e.g. aluminum, steel), fiberglass, carbon fiber, and wood. The collar may be constructed from combinations of the different materials, e.g. one portion steel for strength, and another portion plastic for weight reduction. Thus, portions of the collar that are weight-bearing or wear-intensive may be constructed from stronger materials, while other portions may be constructed from lighter materials to reduce the overall weight.

In general, the materials used in manufacturing the collar may be dependent on the end-user's specifications and/or nature of use. For example, metal may be used in environments with petro-chemical exposure, whereas fiberglass may be used acidic environments or when non-conductive material is needed. The most common manufacturing processes used for plastic collars are injection molding and plastic thermo-forming. For metal collars, metal stamping and metal spinning processes are most commonly utilized.

Sparking can occur if a metal object strikes the metal ring of the manhole. Non-metallic collars also prevent or reduce sparking that may occur when metal objects are lowered into or raised from the manhole. This is advantageous when flammable or explosive materials, e.g. liquids or gases, may be present in or around the manhole.

Note that a smaller version of a collar, e.g. 4-6 inch diameter, may be used to cover refueling hatches and prevent sparks when inserting a fuel hose into a underground storage tank.

The collars can be characterized as one of three types. The first type is a rescue collar. The rescue collar has few features and is designed for use by rescue personnel. The rescue collar is designed to be quickly setup during a rescue. The rescue collar would be used for a short duration, e.g. during a rescue operation. The second type is a construction collar. The construction collar has many features which allow easy access of personnel and materials into the manhole. The construction collar is designed to be in place for a longer period of time than a rescue operation, e.g. a day, a week, a month, or even longer. The third type is a hybrid collar, which is a hybrid of the rescue collar and the construction collar.

FIGS. 1-3 depict one example of a collar 100. Note that other collars may have different sizes, thicknesses, and shapes. The dimensions shown in the Figures are by way of example only, as other dimensions may be used. Portion 101 of the collar extends to cover part of the surface of into which the manhole opens. For example, if the manhole is in a road, then portion 101 covers part of the road. Portion 102 of the collar extends down into the hole or feature that the manhole provides access to. Portion 103 of the collar connects portions 101 and 102 and forms a continuous surface that has no sharp edges or discontinuities. The collar 100 may be considered a rescue collar.

Note that the collar discussed and depicted herein is shown to be of a circular type by way of example only, as other types of collar may be used to fit other types of manholes, e.g. rectangular or square. For example, FIG. 4 depicts a rectangular collar 400.

As stated earlier, manholes come in different sizes. Thus, one embodiment of a collar may have the collar change size to fit various manholes. For example, the collar 500 of FIG. 5A has sliding members 501, that allow for the corner 502 to be moved to allow for the collar to fit different types of holes. FIG. 5B depicts the collar 500 with the upper and lower members 501 set to a closed position. This would allow the collar 500 to fit into a rectangular manhole.

FIG. 6 depicts another collar embodiment that allows collar 600 to be fit to different sized manholes. The collar comprises corner portions 601 and side portions 602. The side portions come in different sizes 602*a*, 602*b*. Different side portions 602 can be used to allow the collar to fit different manholes. For example, by using side portions 602*a*, the collar would fit a larger manhole, while side portions 602*c* would be used to fit a smaller manhole.

Note that the collar does not have to fit perfectly into the manhole, just close enough so that the collar does not fall into the manhole. For example, as shown in FIG. 7, a rectangular collar 701 has been placed into a circular manhole 702. The corners of the collar 701 would support the weight of the collar 701 and any lines that are laid down into the manhole. Note that a circular collar can be placed into a rectangular or square manhole.

Collars can be difficult to store. Collars, particularly collars designed for large manholes, can be bulky and large themselves. In one embodiment, as shown in FIG. 8A, the collar 800 includes a hinge 801 that allows the collar to be folded in half for storage. The collar may be unfolded before use, or the collar 800 may be placed into the manhole in a folded state, and then unfolded for use. FIG. 8B depicts another embodiment of a collar that is easier to store. The collar 802 is comprised of two pieces that are placed together for use. The collar may be assembled for use before being placed into the manhole or may be assembled after one piece has been placed into the manhole. More specifically, one piece is placed into the manhole, and then the other pieces is placed into the manhole and connected to the first piece. Note that this embodiment is advantageous in that the collar may used after equipment, especially lines have already been inserted into the manhole. In some rescue operations, time may be critical. Thus personal may enter the manhole and lower lines into the manhole. A person on the surface may move the lines or hoses away from the manhole sides and then insert the collar piecewise to protect the lines. This embodiment may have more than two pieces, e.g. collar 600 of FIG. 6.

In some manholes, there is another sharp edge 902 namely on the lower portion of the manhole opening. Thus, collar 900, includes a moveable skirt portion 901 that can extend downward. Thus, any lines or hoses that may be pulled to one side of the manhole would be protected from edge 902. The skirt portion 901 shown in FIG. 9 is slideably moveable. Other adjustable skirt portions may include skirts that fasten onto the lower portion 102 of a collar. This would extend the protection further into the manhole. Note that depth of portion that extends in the manhole, e.g. portion 102, may vary as needed.

In some situations, there may be personal working on the surface adjacent to the manhole. The collar may have a lip portion that extends upward from the collar to prevent tools, items, debris, from falling into the manhole. Such a collar 1000 is shown in FIG. 10, and includes a raised portion 1001 that reduces the opportunity of items inadvertently falling into a manhole.

In some situations, liquid material, e.g. water may be pumped or otherwise removed from the manhole. The collar may have a seal ring on the underside of the top portion to prevent or reduce liquids or fluids from entering in the manhole. Such a collar 1000 is shown in FIG. 10, and includes a seal portion 1002 that reduces or prevents liquid from draining into the manhole. Furthermore, the seal would reduce or prevent surface liquids, e.g. rainwater, from entering into the manhole.

The collar can also be used to identify a site as a work site or the site of an emergency. To make such identification more readily, the collar may be painted a particular color (e.g. yellow for work or red for emergency). The portions of the collar may also be covered with a reflective material, e.g. reflectors or reflective tape. For example, the collar 1100 of FIG. 11 includes reflective material 1101.

The collar may also be equipped with embedded lights to assist in marking the entry. The lights may be white, yellow, or red as desired. For example, FIG. 11 depicts a collar 1100 having lights 1102, 1103, and 1104. The lights 1102 would mark the location of the collar. The lights 1103 would make the entrance into the hole. The lights 1103 may also be used to illuminate the entrance. The lights 1104 can be used to mark the location of the lower entrance of the manhole. For example, some manholes open in the large room sized areas or even caverns. If the room is dark or smoke filled, then it may be difficult to find the manhole to exits. The lights 1104 would make it easy to locate the manhole. The lights 1104 can also be used to illuminate the passage down the manhole and/or illuminate an interior area adjacent to the manhole. The lights may be powered by a small replaceable/rechargeable battery 1105 that is located in a portion of the ring, and/or the collar may feature a power plug 1106 to be connected to an external power source.

For construction collar, e.g. those collars that will be in place for extended periods of time may incorporate one or more connection point or ports that would limit the amount of lines that would have to be placed into the manhole opening. These lines, e.g. power, air, data, communication, can make it difficult to enter and exit the manhole. Personnel may become entangled with the lines at the manhole opening. The structure of the collar would provide pathways for the various materials into or out of the manhole. This would reduce the number of lines that would be located within the collar and ease movement of personnel into and out of the manhole.

FIG. 12 depicts a collar 1200 that includes power and/or data ports. The collar has an upper power or data line port 1201 into which would couple with a power or data line from the surface. Ports 1202, 1203, and 1204 would then allow attachment of power and/or data lines below the surface Port 1202 could be used when the skirt portion 102 extends below the manhole opening. Ports 1203 and/or 1204 could be used if the manhole extents below the skirt portion. Note that multiple ports could be placed around the periphery of the collar. Different ports could have different functions, e.g. data, USB, 12 volt power, 24 volt power, 110 volt power, etc.

FIG. 13 depicts a collar 1300 that includes oxygen or air ports. The collar has an upper air input port 1301 into which would couple with a source of oxygen or breathable air located on the surface. Ports 1302, 1303, and 1304 would then allow attachment of air lines below the surface Port 1302 could be used when the skirt portion 102 extends below the manhole opening. Ports 1303 and/or 1304 could be used if the manhole extents below the skirt portion. Note that multiple ports could be placed around the periphery of the collar. Note that in some instances other gases may be needed in the manhole. For example, some equipment may require nitrogen or other gas. This arrangement could be used to provide the gas below ground.

FIG. 14 depicts a collar that includes a fan motor 1401 that can below air into or out of the manhole. Surface port 1402 (there may be more than one) may be one endpoint of the air flow path. Subsurface ports 1403 (there may be more than one) is the other endpoint of the air path. Thus the motor 1401 could be used to draw air from port 1402 and inject the air into the manhole via ports 1403. Similarly, the motor could be used to draw air from within the manhole and expel it from port 1402.

FIGS. 15 A and 15B depict a collar 1500 that is similar to the collar 1400 of FIG. 14 but does not include the fan motor. Instead, the collar 1500 may be connected via lines to a fan 1501 the is located on the surface and/or a fan 1502 that is located in the manhole. Note that both fans 1501 and 1502 may be used so long as they are set to send air in the same direction, i.e. either both set to send air into the manhole or both set to send air out of the manhole.

Manholes may lead to subsurface rooms that are dark or have low visibility. Thus, it is easy to leave a tool or piece of equipment behind. To prevent such losses, the collar 1600 of FIG. 16 may include a counter system. Equipment and/or personnel may be tagged with electronically readable tags, for example RFID tags. As a tagged item moves into the manhole it first passes sensor 1601 and then passes senor 1602. This sequence would indicate that the tagged item has been moved into the manhole. The sensors may be connected to a processor 1603 that is located within the collar or may be connected to a processor that is external to the collar via port 1605. In any event, the processor 1603 tracks the entry of a tagged item. As a tagged item leaves the manhole, the item first passes sensor 1602 and then passes sensor 1601. This sequence would indicate that the tagged item has been moved out of the manhole. Again, the processor notes the exit of a tagged item. The processor may keep track of just a simple datum such as the number of items, e.g. 20 items in and 19 items out would indicate that one item still remains in the manhole. The processor may track the specifics of each item, such that the processor may note that Fred Smith's hammer is still in the manhole. This would require a database of tags and associated item identification. The collar may include interface 1604, which may be a touch screen, to interact with the processor 1603. Note that personnel can also be tagged, thus preventing an injured or unconscious person for inadvertently being left behind.

FIG. 17 depicts a collar 1700 that includes passages 1701 or 1702 that are located within the collar that allow for lines to be passed through the collar. This is an alternative to the port arrangements of FIGS. 12-15. With this collar, various lines may be passed through the collar, and thus located away from the portion of the collar that personnel would use. This would prevent personnel from being entangled with the lines during entry/exit from the manhole. Passage 1701 is provided within the collar structure, while passage 1702 is occupies a portion of the entry way. Note that passage 1701 would work best if the collar is smaller than the manhole. For example, in FIG. 7, a 1701 passage could be located at portion 1703 of collar 700.

FIGS. 18A and 18B depict another embodiment that would reduce or prevent personnel from being entangled with the lines during entry/exit from the manhole. The collar comprises two pieces an outer piece 1801 and an inner piece 1803. The outer piece would first be placed into the manhole. Then lines 1802 are fed into the manhole. Then inner piece 1803 is placed into outer piece 1801. The lines are moved to the periphery, between the outer piece and the inner piece. Any person entering/leaving the manhole would pass through the inner piece and not encounter any lines. If additional lines need to be fed into the manhole, the inner piece is removed, and the lines are then fed into the manhole. The inner piece is then replaced into the outer piece. The outer piece provides protection to the lines from the manhole edges. The inner piece provides protection to the lines from damage from entanglement with a person. The inner pieces reduces the chances of injury to a person from entanglement with lines. One (or both) of the inner piece and the outer piece includes spacers 1804 that separate the two pieces and prevents the lines from being crushed.

FIG. 19 depicts another embodiment of a collar 1900 that includes handles 1901, 1902 that allow the collar to be easily maneuvered. As stated earlier, the collar can be bulky and awkward to move. Thus, handles 1901 may be located on the surface of the collar to allow a person to more easily carry the collar. The handles may allow for easier placement of the collar into the manhole. The handles may also be built into the collar as handholds 1902. The handholds allow a person the grip into the collar and do not protrude from the collar.

The collar 1900 may also include one or more rungs 1903 that lead down the manhole. This would allow for easier entry into or exit from the manhole.

A stated earlier a rescue collar may be simpler collar, in that less time would be spent to set up the collar. Thus, a rescue collar may include any combination of features such as those shown in FIGS. 1-3, FIGS. 5A and 5B, FIG. 6, FIGS. 8A and 8B, FIG. 9, and FIG. 10. A construction collar may include any combination of features of the rescue collar and those of FIGS. 11-19. A hybrid collar may include those of the rescue collar and one or two of the features shown in FIGS. 11-19. Note that a collar may have any of the features shown in the various figures in any combination.

The manhole that has been described herein may provide access for sewers, telecom equipment, gas lines, utility lines, or even access on vehicles such as ships, military tanks, etc.

The various embodiments described here have been done so in terms of a manhole. However, these embodiments described herein may be used for holding tanks, tank trucks, vehicle hatches, other vertical access portals.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated that the conception and specific embodiment disclosed may be readily utilized as a basis for modifying or designing other structures for carrying out the same purposes of the present invention. It should also be realized that such equivalent constructions do not depart from the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

What is claimed is:

1. A device comprising:

a first portion that has a diameter that is larger than that of a manhole and covers a surface that is adjacent to the manhole;

a second portion that has a diameter that is smaller than that of the manhole and extends into the opening of the manhole;

a third portion that connects the first portion and the second portion; and an opening that is formed by the first portion, the second portion, and the third portion;

wherein in operation, the device is removably placed about a manhole with the first portion extending around the manhole, the third portion extending into the manhole, and the opening providing access to the manhole;

wherein the first portion, the second portion, and the third portion form a continuous surface that lacks sharp edges and lacks discontinuities.

2. The device of claim 1, wherein the device is comprised of one or more of plastic, ABS plastic, metal, aluminum, steel, fiberglass, carbon fiber, and wood.

3. The device of claim 1, wherein the manhole and the device have a round shape.

4. The device of claim 1, wherein the manhole and device have a rectangular shape.

5. The device of claim 1, wherein the manhole is one of a round shape and a rectangular shape and the device is the other of the rectangular shape and the round shape.

6. The device of claim 1, wherein the device is adjustable to accommodate different sized manholes.

7. The device of claim 6, wherein the adjustable device has sliding portions that can adjust a size of the device to accommodate a size of the manhole.

8. The device of claim 6, wherein the adjustable device is formed from pieces, and the pieces are selected from a plurality of pieces to accommodate a size of the manhole.

9. The device of claim 1, wherein the device comprises at least two pieces.

10. The device of claim 9, further comprising:

a hinge that connects the two pieces;

wherein the hinge allows the device to be folded for storage.

11. The device of claim 9, further comprising:

a connector that connects the two pieces;

wherein the connector allows the device to be disassembled for storages.

12. The device of claim 1, further comprising:

a skirt portion that abuts the second portion and extends further into the manhole.

13. The device of claim 1, further comprising:

a raised portion that is located on the first portion;

whereby the raised portion provides a barrier to undesired objects from falling into the manhole.

14. The device of claim 1, further comprising:

a seal that is located between the first portion and the surface;

whereby the seal reduces undesired liquids from falling into the manhole.

15. The device of claim 1, further comprising:

a signal device to mark the manhole as being open.

16. The device of claim 15, wherein the signal device comprises one or paint and reflective tape.

17. The device of claim 15, wherein the signal device at least one light.

18. The device of claim 1, further comprising:

at least one light that is located in second portion to provide light into the manhole.

19. The device of claim 1, further comprising:

at least one surface port located in the first portion that provides a connecting point for a line; and at least one subsurface port located in the second portion the provide a connecting point for another line;

wherein the surface port and the subsurface port are operably connected with each other through the third portion.

20. The device of claim 19, wherein the surface port and the subsurface port allow for one of power, data, communication, air, oxygen, or other chemical to be provided into the manhole.

21. The device of claim 1, further comprising:

a fan that blows air into or removes air from the manhole.

22. The device of claim 1, further comprising:

a port located in the third portion that allows a line to be placed into the manhole along a surface of the manhole.

23. The device of claim 1, further comprising:

a tracking system that tracks an entry and an exit of at least one item with the manhole.

24. The device of claim 1, further comprising:

a fourth portion that inserted into the second portion and covers any equipment that has been inserted into the manhole.

25. The device of claim 1, further comprising:

at least one handle to assist in moving the device.

26. The device of claim 1, further comprising:

at least one rung to assist in personnel in entering and exiting the manhole.

27. A method of using a protective cover comprising:

removably inserting a protective cover over an abrupt edge of an entry interface between a surface and a subsurface compartment, wherein the protective cover completely extends about the perimeter of the entry interface, wherein the protective cover extends into the entry interface, and wherein the protective cover lacks sharp edges and lacks discontinuities; and disposing at least one piece of equipment into the subsurface compartment over the protective collar via an opening in the protective cover.

28. The method of claim 27, wherein the subsurface compartment is one of a manhole, a storage tank, a holding tank, a tank truck, a vehicle hatch, and a vertical access point.

29. The method of claim 27, wherein the piece of equipment is one of a hose, a cable, a tool, a sensor, and a test device.

30. The method of claim 27, further comprising:

entering the subsurface compartment by a human over the protective cover.

31. The method of claim 27, further comprising:

removing the at least one piece of equipment from the subsurface compartment over the protective cover; and removing the protective cover from the interface.

* * * * *